US008360416B2

(12) United States Patent
Hayama

(10) Patent No.: US 8,360,416 B2
(45) Date of Patent: Jan. 29, 2013

(54) SHEET REMAINING AMOUNT DETECTION DEVICE AND IMAGE FORMING APPARATUS

(75) Inventor: Satoru Hayama, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 13/172,198

(22) Filed: Jun. 29, 2011

(65) Prior Publication Data

US 2012/0001380 A1 Jan. 5, 2012

(30) Foreign Application Priority Data

Jun. 30, 2010 (JP) ..... 2010-149617

(51) Int. Cl.
*B65H 1/08* (2006.01)
*B65H 1/26* (2006.01)

(52) U.S. Cl. ..... 271/147; 271/157

(58) Field of Classification Search ..... 271/147, 271/157; 414/796.7
See application file for complete search history.

(56) References Cited

U.S. PATENT DOCUMENTS 2,141,418 A * 12/1938 Sinkovitz ..... 475/16
2,368,094 A * 1/1945 Baker et al. ..... 271/157
4,033,578 A * 7/1977 Taylor et al. ..... 271/157
4,976,421 A * 12/1990 Kanaya ..... 271/258.01
5,700,006 A * 12/1997 Sekiya et al. ..... 271/241
5,971,387 A * 10/1999 Kita ..... 271/9.03
7,147,218 B2 * 12/2006 Izumi et al. ..... 271/145
7,681,879 B2 * 3/2010 Fuchi ..... 271/162
2009/0166950 A1 * 7/2009 Sciurba et al. ..... 271/9.03

FOREIGN PATENT DOCUMENTS

JP 2001-80792 3/2001

* cited by examiner

*Primary Examiner* — David H Bollinger
(74) *Attorney, Agent, or Firm* — Gerald E. Hespos; Michael J. Porco

(57) ABSTRACT

A sheet feeder includes a tray on which sheets are to be placed, a rope connected to the tray, a pulley which includes a shaft and on which the rope is taken up such that the winds thereof are aligned in an axial direction of the shaft, and a motor for moving the tray upward by rotating the pulley about the shaft in a direction to take up the rope to locate the uppermost sheet on the tray at a sheet pickup position. A sheet remaining amount detection device applied to this sheet feeder includes a position detector for detecting a present position which is a present take-up position of the rope on the pulley in the axial direction, and a remaining amount detecting section for detecting the remaining amount of the sheets on the tray based on the present position detected by the position detector.

12 Claims, 12 Drawing Sheets

SHEET REMAINING AMOUNT DETECTION DEVICE AND IMAGE FORMING APPARATUS

BACKGROUND OF THE INVENTION

1. Field of the Invention

The present invention relates to a sheet remaining amount detection device applied to a sheet feeding mechanism constructed such that a tray bearing sheets is moved upward by taking up a rope (e.g. wire rope) on a take-up pulley, and an image forming apparatus including such a device.

2. Description of the Related Art

Recently, sheet feeding mechanisms which stock a relatively large number of sheets and feed these sheets have been widely used. A sheet feeding mechanism having the following construction has been proposed as such a sheet feeding mechanism.

Upon feeding sheets placed on a sheet tray, the sheet tray is moved upward so that the uppermost one of the sheets is located at a preset feeding position. A wire is fixed to the sheet tray, which is moved upward by taking up the wire using a drive force of a motor.

After being located at a predetermined lowest position, the sheet tray is so moved upward that the uppermost sheet on the sheet tray is located at the feeding position and the number of revolutions of the motor in the process of moving the sheet tray upward is counted. Based on the count value, the remaining amount of sheets on the sheet tray is detected.

However, since the count value on the number of revolutions of the motor is stored in a memory such as a DRAM in the above conventional sheet feeding mechanism, the count value stored in the memory is cleared if a power supply for the sheet feeding mechanism is disconnected.

Thus, the present position of the tray is not known when the sheet feeding mechanism is restarted, wherefore the present position of the tray has to be confirmed by lowering the sheet tray to the lowest position again, moving the sheet tray upward until the uppermost sheet on the sheet tray reaches the feeding position and counting the number of revolutions of the motor at that time. Power consumption is wasted if the sheet tray is moved upward and downward again in this way.

SUMMARY OF THE INVENTION

An object of the present invention is to provide a sheet remaining amount detection device capable of detecting a sheet remaining amount without wasting power consumption and an image forming apparatus including such a device.

One aspect of the present invention is directed to a sheet remaining amount detection device, comprising a sheet storage unit which stores sheets and in which a sheet pickup position where the sheets are picked up is set beforehand; a tray which is provided in the sheet storage unit in such a manner as to be vertically movable between the sheet pickup position and a lowest position lower than the sheet pickup position and on which the sheets are to be placed; a rope connected to the tray; a pulley which includes a shaft and on which the rope is taken up with the winds of the rope aligned (in other words, successively aligned) in an axial direction of the shaft; a motor for moving the tray upward by rotating the pulley about the shaft in a direction to take up the rope to locate the uppermost one of the sheets placed on the tray to the sheet pickup position; a position detector for detecting a present position which is a present take-up position of the rope on the pulley in the axial direction; and a remaining amount detecting section for detecting the remaining amount of the sheets placed on the tray based on the present position detected by the position detector.

Another aspect of the present invention is directed to an image forming apparatus, comprising a sheet remaining amount detection device having the above construction; a conveying unit for conveying the uppermost one of sheets stored in the sheet storage unit; and an image forming unit for forming an image on the sheet conveyed by the conveying unit.

These and other objects, features and advantages of the present invention will become more apparent upon reading the following detailed description along with the accompanying drawings.

DETAILED DESCRIPTION OF THE PREFERRED EMBODIMENTS

Figure 1:
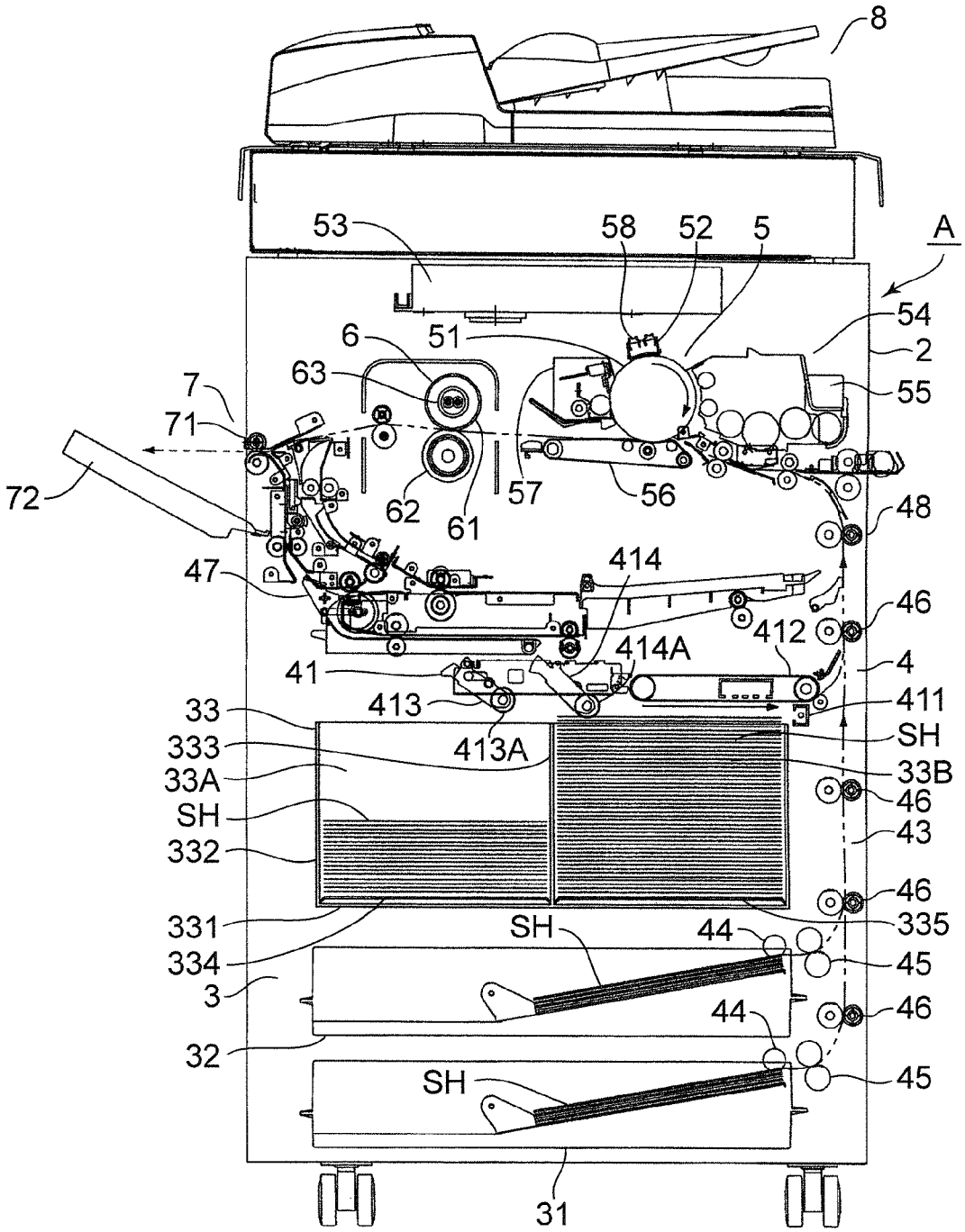
FIG. 1 is a schematic sectional view showing an exemplary image forming apparatus according to one embodiment of the invention.

Hereinafter, a sheet remaining amount detection device and an image forming apparatus according to one embodiment of the present invention are described with reference to the drawings. FIG. 1 is a schematic sectional view showing an exemplary image forming apparatus according to the embodiment of the invention. Note that the sheet remaining amount detection device according to the embodiment of the present invention is included in the image forming apparatus shown in FIG. 1.

As shown in FIG. 1, an image forming apparatus A includes a substantially rectangular parallelepipedic housing 2, a storage unit 3 which is arranged in a lower part of the internal space of the housing 2 and in which sheets SH are stored, a conveying unit 4 for picking up a sheet SH from the storage unit 3 and conveying it, an image forming unit 5 for forming a toner image on a surface of the sheet SH being conveyed, a fixing unit 6 for fixing the toner image formed on the sheet to the surface of the sheet SH and a discharging unit 7 for discharging the sheet SH having the toner image fixed thereto to the outside of the housing 2. A document reading unit 8 for reading a document image is arranged atop the housing 2. The document reading unit 8 reads a document image and converts it into electronic data.

The storage unit 3 includes a first cartridge 31 and a second cartridge 32 each storing a stack of a small number of sheets SH. The second cartridge 32 is arranged above the first cartridge 31. The storage unit 3 further includes a stocker (sheet storing unit) 33 for storing more sheets than those that can be stored in the first and second cartridges 31, 32. The stocker 33 is arranged above the second cartridge 32.

The stocker 33 includes a bottom portion 331 substantially in the form of a rectangular plate and a peripheral wall portion 332 extending upward from the peripheral edge of the bottom portion 331. The upper edge of the peripheral wall portion 332 forms an opening of the stocker 33. Sheets SH stored in the internal space of the stocker 33 defined by the bottom portion 331 and the peripheral wall portion 332 are picked up by the conveying unit 4 through the opening formed at the top of the stocker 33 and conveyed toward the image forming unit 5. The first cartridge 31, the second cartridge 32 and the stocker 33 can be pulled out of the housing 2.

The stocker 33 includes a partition plate 333 arranged across the internal space of the stocker 33. The partition plate 333 extends upward from the bottom portion 331 and partitions the internal space of the stocker 33 into smaller spaces laterally adjacent to each other in FIG. 1. The smaller space formed on the left side serves as a first storing portion 33A and that formed on the left side serves as a second storing portion 33B.

A first tray 334 is arranged in the first storing portion 33A and a second tray 335 is arranged in the second storing portion 33B. The first tray 334 has an upper surface on which a stack of sheets SH is to be placed. The second tray 335 also has an upper surface on which a stack of sheets SH is to be placed.

The first and second trays 334, 335 are vertically movable between a lowest position PL and a sheet pickup position PH set beforehand in the stocker 33.

The conveying unit 4 includes a conveyance path 43 vertically extending at the right side of the storage unit 3. Sheets SH picked up from the stocker 33 by sheet pickup rollers 413A, 414A are conveyed to the conveyance path 43 by a belt device 412 and head for the image forming unit 5 via the conveyance path 43.

The sheet pickup roller 413A is provided in a first roller device 413, and the sheet pickup roller 414A is provided in a second roller device 414. The first and second roller devices 413, 414 are mounted rotatably relative to the housing 2 and pushed upward by the sheets SH placed in the stocker 33 to change angles thereof to a horizontal plate.

When the angles between the first and second roller devices 413 and 414 and the horizontal plane reach a predetermined angle, the drive of motors for generating forces to push the first and second roller devices 413, 414 upward is stopped.

The conveying unit 4 further includes pickup rollers 44 arranged near the right upper corners of the first and second cartridges 31, 32, and separating feed rollers 45 arranged near and downstream of the pickup rollers 44. The pickup rollers 44 and the separating feed rollers 45 pick up the sheets SH one by one from the first and second cartridges 31, 32 and convey them to the conveyance path 43. The conveying unit 4 further includes a plurality of conveyor rollers 46 arranged along the conveyance path 43. The conveyor rollers 46 convey the sheet SH fed from the first or second cartridge 31 or 32 to the image forming unit 5 via the conveyance path 43.

The image forming unit 5 includes a substantially cylindrical photoconductive drum 51 rotatably supported in the housing 2 and a charger 52 arranged above the photoconductive drum 51. The photoconductive drum 51 rotates clockwise in FIG. 1. The charger 52 applies electric charges to the photoconductive drum 51 to uniformly charge the circumferential surface of the photoconductive drum 51. The image forming unit 5 further includes an exposure device 53. The exposure device 53 irradiates the charged circumferential surface of the photoconductive drum 51 with a laser beam based on image data obtained by the document reading unit 8 reading a document image. As a result, the laser beam neutralizes the electric charges on the photoconductive drum 51, wherefore an electrostatic latent image in conformity with the image data is formed on the photoconductive drum 51. The image forming unit 5 further includes a developing device 54. The developing device 54 includes a toner container 55 for containing toner, and the toner is supplied from the toner container 55 to the circumferential surface of the photoconductive drum 51 having the electrostatic latent image formed thereon. As a result, a toner image in conformity with the electrostatic latent image is formed on the circumferential surface of the photoconductive drum 51.

The image forming unit 5 further includes a transfer belt 56 arranged below the photoconductive drum 51. A sheet SH is fed to between the photoconductive drum 51 and the transfer belt 56 via the conveyance path 43. When the sheet SH passes between the photoconductive drum 51 and the transfer belt 56, the toner image formed on the circumferential surface of the photoconductive drum 51 is transferred to the sheet SH by application of a reverse bias having a polarity opposite to that of the electrification of the toner.

The image forming unit 5 further includes a cleaning device 57 for removing the toner residual on the circumferential surface of the photoconductive drum 51 after the transfer of the toner image to the sheet SH and a charge removing device 58 for removing residual charges from the circumferential surface of the photoconductive drum 51 having the residual toner removed therefrom.

The sheet SH having the toner image transferred thereto in the image forming unit 5 is fed to the fixing unit 6. The fixing unit 6 includes a fixing roller 61 and a pressure roller 62 pressed in contact with the fixing roller 61. A heat source 63 is arranged inside the fixing roller 61 to melt the toner on the sheet SH passing between the fixing roller 61 and the pressure roller 62, and the toner is fixed to the sheet SH by pressure from the pressure roller 62. In this way, the toner image is fixed to the sheet SH.

The discharging unit 7 includes discharge rollers 71 mounted downstream of the fixing unit 6 and near the inner wall surface of the housing 2 and a discharge tray 72 for receiving the sheet SH discharged to the outside of the housing 2 by the discharge rollers 71.

The image forming apparatus A shown in FIG. 1 includes a conveyance path 47 for duplex printing between the stocker 33 and the image forming unit 5/fixing unit 6. The discharge rollers 71 can feed the sheet SH to the conveyance path 47 by a switch-back method. The conveyance path 47 joins the conveyance path 43 immediately before registration rollers 48 arranged at an intermediate position of the conveyance path 43. The sheet SH having passed in the conveyance path 47 is fed to the image forming unit 5 by the registration rollers 48, and a toner image is transferred to a side of the sheet SH, on which no toner image is fixed, in the image forming unit 5. Thereafter, the newly transferred toner image is fixed to the sheet SH by the fixing unit 6. Finally, the sheet SH is discharged onto the discharge tray 72 by the discharge rollers 71.

Figure 2:
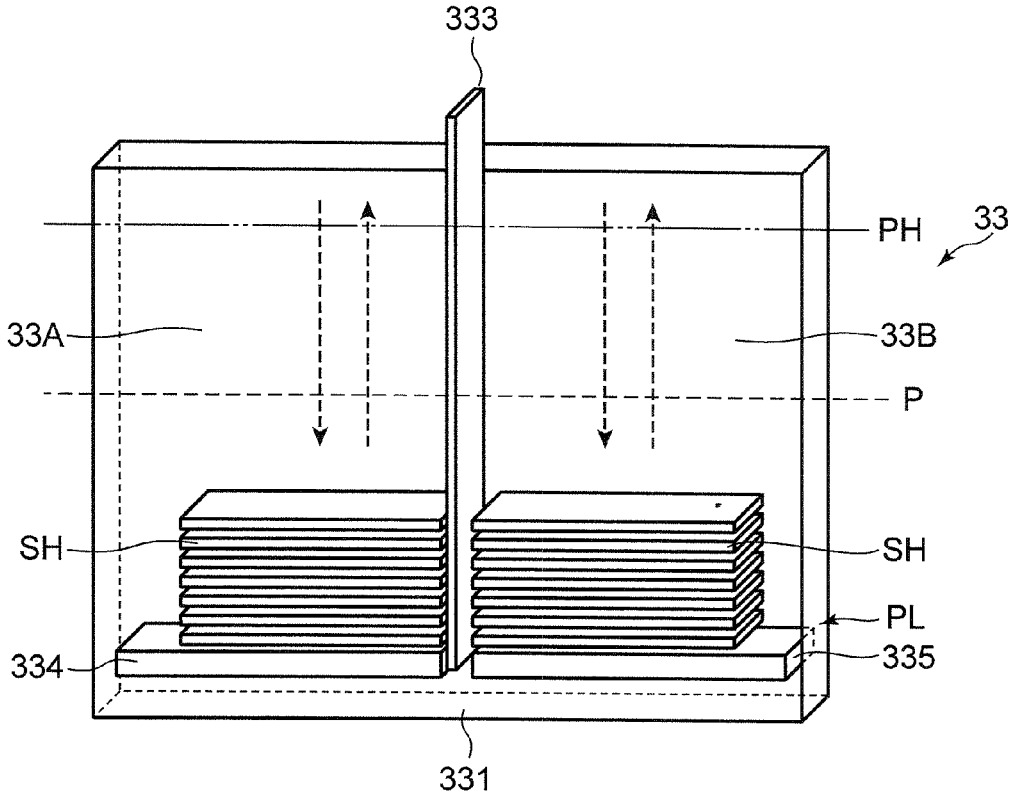
FIG. 2 is a diagram conceptually showing an exemplary external appearance of a stocker.

FIG. 2 is a diagram conceptually showing an exemplary external appearance of the stocker 33. Note that the same constituent elements as those in FIG. 1 are identified by the same reference numerals and not described.

In the stocker 33, the first and second trays 334, 335 are in contact with the bottom portion 331 of the stocker 33 when a preset maximum number of sheets SH are placed on the upper surfaces of the first and second trays 334, 335. The position of the upper surfaces of the first and second trays 334, 335 at this time is set as the lowest position PL described above. In other words, the lowest position PL is the position of the upper surfaces of the first and second trays 334, 335 when the first and second trays 334, 335 are lowered most and the maximum number of sheets SH are placed on these trays. FIG. 2 shows a state where the upper surfaces of the first and second trays 334, 335 are located at the lowest position PL.

When the maximum number of sheets SH are placed, the upper surfaces of the first and second trays 334, 335 are at the lowest position PL and the uppermost ones of the sheets SH placed on the upper surfaces of the first and second trays 334, 335 are located at the sheet pickup position PH. When being located at the sheet pickup position PH, the uppermost sheets SH are in contact with the sheet pickup rollers 413A, 414A.

When the uppermost ones of the sheets SH on the first and second trays 334, 335 successively picked up, the number of the sheets SH on the first and second trays 334, 335 decreases. Then, the uppermost ones of the sheets SH on the first and second trays 334, 335 are no longer in contact with the sheet pickup rollers 413A, 414A.

As the number of the sheets SH on the first and second trays 334, 335 decreases, the first and second trays 334, 335 are moved upward by drive forces of motors to be described later. Then, the uppermost ones of the sheets SH on the first and second trays 334, 335 come into contact with the sheet pickup rollers 413A, 414A. Thus, even if the number of the sheets SH on the first and second trays 334, 335 decreases, the uppermost sheets can be successively picked up.

In the following description, it is assumed that P denotes the position of the upper surfaces of the first and second trays 334, 335 when the uppermost ones of the sheets SH on the first and second trays 334, 335 are located at the sheet pickup position PH, i.e. the uppermost sheets SH are in contact with the sheet pickup rollers 413A, 414A.

Figure 3:
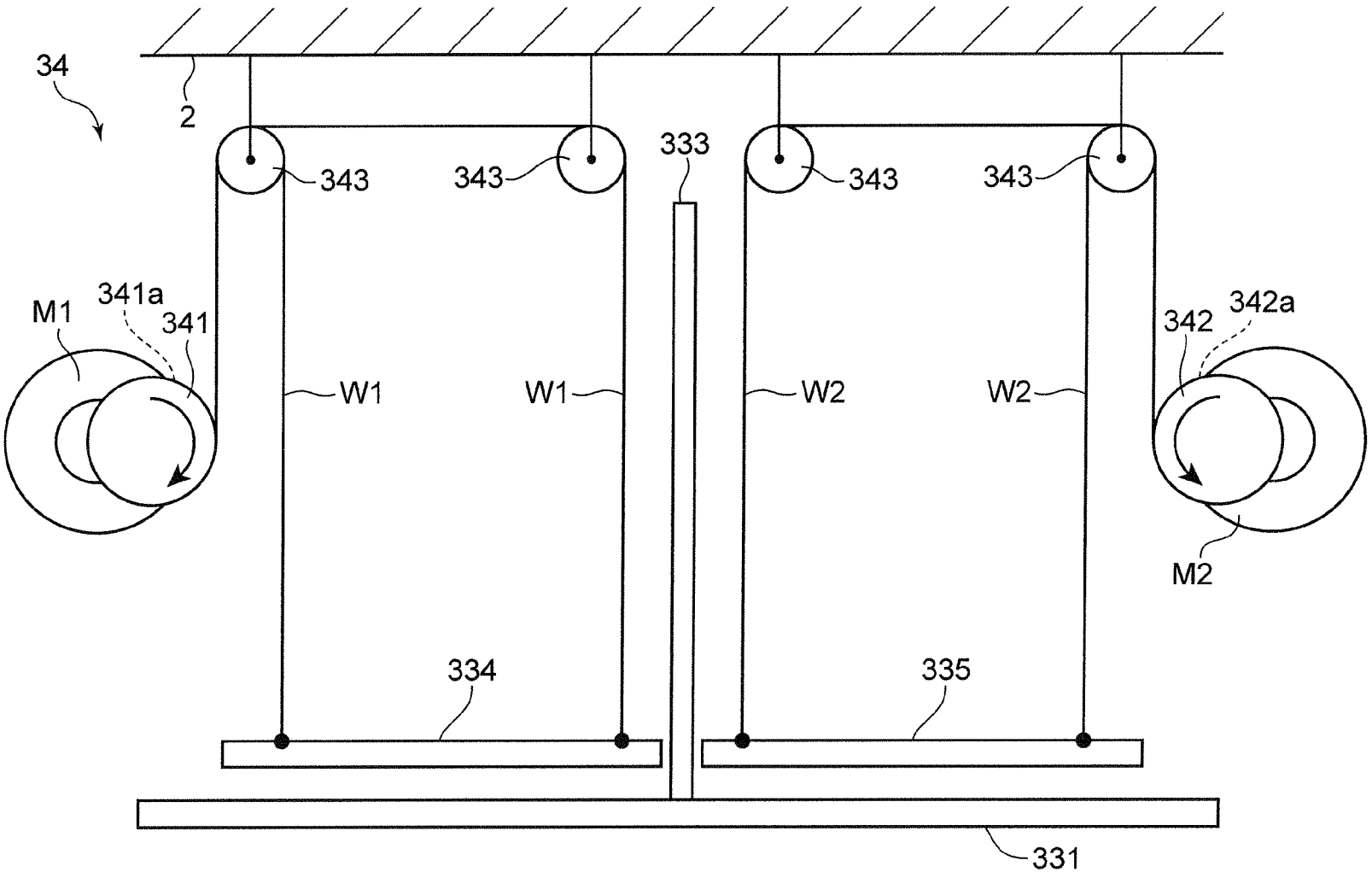
FIG. 3 is a diagram showing an exemplary elevating mechanism for moving a first tray and a second tray upward and downward in the stocker.

FIG. 3 is a diagram showing an exemplary elevating mechanism for moving the first and second trays 334, 335 upward and downward in the stocker 33.

First, out of the elevating mechanism 34, a construction for moving the first tray 334 upward and downward is described. There are two first wires (ropes) W1. The respective first wires W1 are mounted on corresponding fixed pulleys 343. One end of one first wire W1 is fixed to one end of the first tray 334. One end of the other first wire W1 is fixed to the other end of the first tray 334. The other end of the one first wire W1 is fixed to a first pulley 341. The other end of the other first wire W1 is fixed to a first pulley 341*a* having the same structure as the first pulley 341 and hidden behind the first pulley 341. Power of a first motor M1 is transmitted to the first pulleys 341*a*, 341 via an unillustrated gear or the like so that the first pulleys 341*a*, 341 rotate in the same direction as a rotating shaft of the first motor M1.

When the rotating shaft of the first motor M1 rotates clockwise, the first pulleys 341, 341*a* rotate clockwise to successively take up the respective first wires W1. In this way, the first tray 334 having the respective first wires W1 fixed thereto is moved upward.

When the first motor M1 is rotated counterclockwise, the first wires W1 are dispensed downward to lower the first tray 334.

Next, out of the elevating mechanism 34, a construction for moving the second tray 335 upward and downward is described. This construction is similar to the one for moving the first tray 334 upward and downward. There are two second wires (ropes) W2. The respective second wires W2 are mounted on corresponding fixed pulleys 343. One end of one second wire W2 is fixed to one end of the second tray 335. One end of the other second wire W2 is fixed to the other end of the second tray 335. The other end of the one second wire W2 is fixed to a second pulley 342. The other end of the other second wire W2 is fixed to a second pulley 342*a* having the same structure as the second pulley 342 and hidden behind the second pulley 342. Power of a second motor M2 is transmitted to the second pulleys 342*a*, 342 via an unillustrated gear or the like so that the second pulleys 342*a*, 342 rotate in the same direction as a rotating shaft of the second motor M2.

When the rotating shaft of the second motor M2 rotates counterclockwise, the second pulleys 342, 342*a* rotate counterclockwise to successively take up the respective second wires W2. In this way, the second tray 335 having the respective second wires W2 fixed thereto is moved upward.

When the second motor M2 is rotated clockwise, the second wires W2 are dispensed downward to lower the second tray 335.

A sheet remaining amount detection device 1 according to this embodiment has a construction for detecting the amount of remaining sheets on the first tray 334 based on a take-up position of the first wire W1 on the first pulley 341 and also a construction for detecting the amount of remaining sheets on the second tray 335 based on a take-up position of the second wire W2 on the second pulley 342.

The construction for detecting the amount of remaining sheets on the first tray 334 based on the take-up position of the first wire W1 on the first pulley 341 is described below.

Note that the construction for detecting the amount of remaining sheets on the second tray 335 based on the take-up position of the second wire W2 on the second pulley 342 is neither described nor shown since being similar to the construction for detecting the amount of remaining sheets on the first tray 334 based on the take-up position of the first wire W1 on the first pulley 341.

Figure 4A:
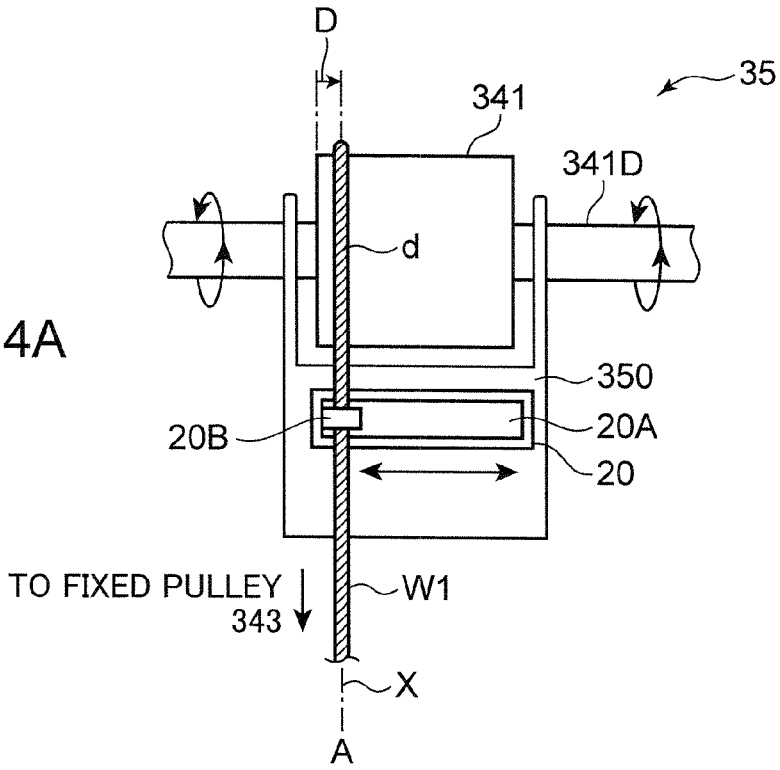
FIGS. 4A and 4B are diagrams showing an exemplary construction of a position detector.
Figure 4B:
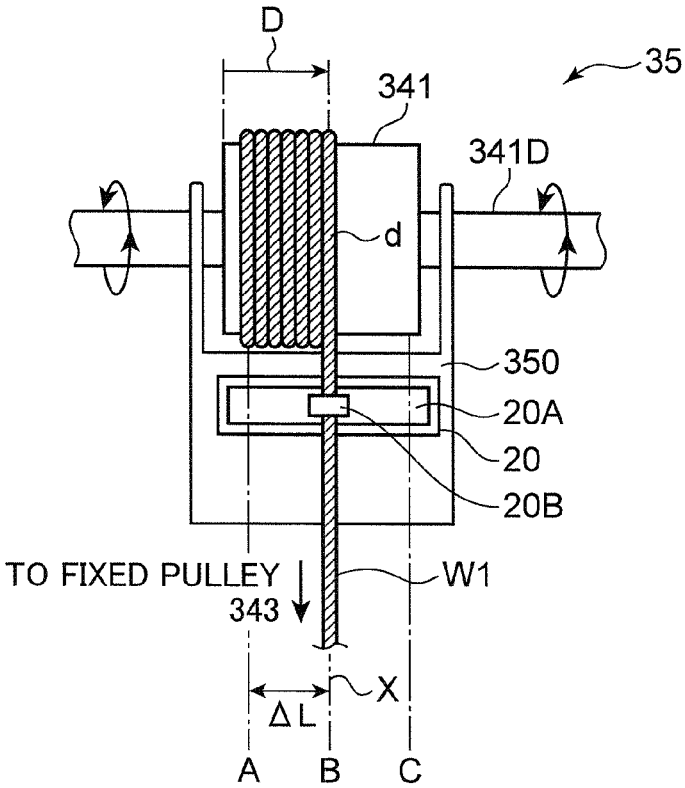
Figure 5:
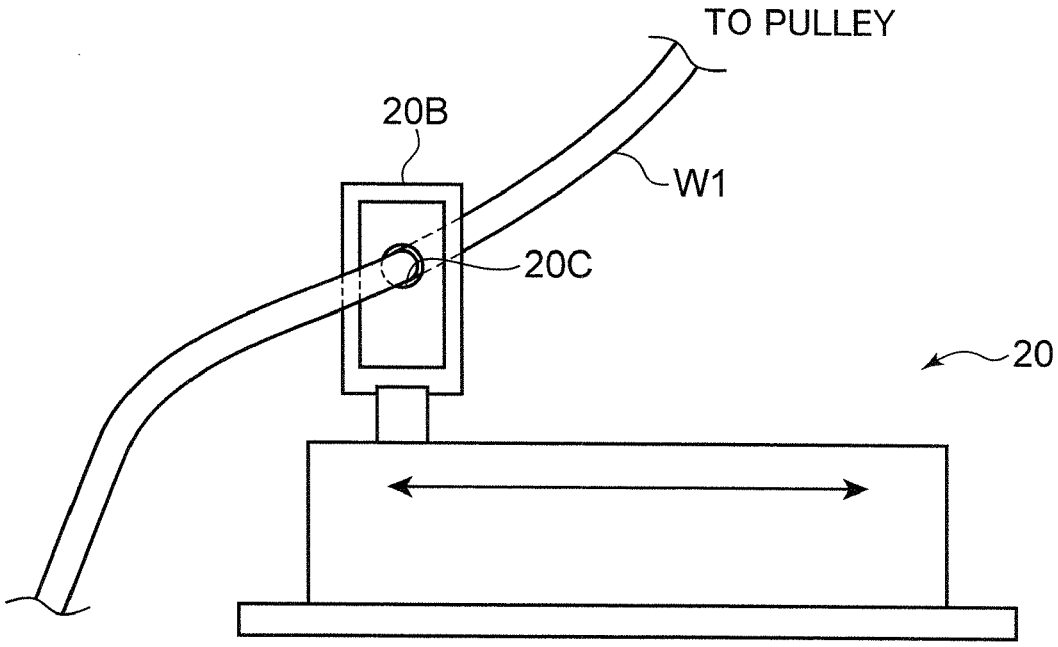
FIG. 5 is a side view showing an exemplary external appearance of a slide resistor.

The sheet remaining amount detection device 1 includes a position detector 35 for detecting a present position D (to be described later) of the first wire W1 on the first pulley 341. FIGS. 4A and 4B are diagrams showing an example of the position detector 35. FIG. 5 is a side view showing an exemplary external appearance of a slide resistor 20.

The upper surface of the first tray 334 is located at the lowest position P1 when the present position (to be described later) D of the first wire W1 and a slide member 20B are located at a position A while being located at the sheet pickup position PH when the present position D of the first wire W1 and the slide member 20B are located at a position C. A partial pressure ratio of the slide resistor 20 is highest at the position A while being lowest at the position C.

The position detector 35 includes a supporting member 350 supporting a shaft 341D of the first pulley 341 and the slide resistor 20 including a slide groove 20A parallel to a direction of the shaft 341D (hereinafter, axial direction) of the first pulley 341.

The slide resistor 20 includes the slide member 20B that slides in and along the slide groove 20A, and the slide member 20B is formed with a through hole 20C through which the first wire W1 is slidably inserted.

The first pulley 341 takes up the first wire W1 so that the winds of the first wire W1 are aligned in the axial direction of the first pulley 341. As the first wire W1 is taken up by the first pulley 341, the present position D moves from one side toward the other side in the axial direction of the first pulley 341. The present position D is the position on the shaft 341D of a part of the first wire W1 which has just arrived at the first pulley 341.

The slide member 20B is normally located on a straight line X. The straight line X is a straight line connecting the present position D of the first wire W1 and a point closest to the first pulley 341 where the fixed pulley 343 and the first wire W1 are in contact. In other words, the slide member 20B is so arranged that the first wire W1 slides on the straight line X passing through the present position D of the first wire W1 and passes through the through hole 20C. Thus, as the present position D of the first wire W1 moves in the axial direction of the first pulley 341, the slide member 20B moves in a moving direction of the present position D.

For example, it is assumed that a state changes from a state where the upper surface of the first tray 334 is located at the lowest position PL, i.e. the present position D of the first wire W1 is located at the position A at the left end side of the first pulley 341 as shown in FIG. 4A to a state where the present position D of the first wire W is located at a position B distant from the position A by ΔL in the axial direction of the first pulley 341 as shown in FIG. 4B.

In this case, the slide member 20B moves a distance ΔL in the axial direction of the first pulley 341 as the take-up position D of the first wire W1 moves, wherefore the position of the slide member 20B changes from the position A to the position B.

When the position of the slide member 20B moves along the axial direction of the first pulley 341 as described above, a intermediate tap TP of the slide resistor 20 slides together with the slide member 20B to linearly change the resistance value of the slide resistor 20. The position detector 35 detects the present position D of the first wire W1 using this changing resistance value. This is described below.

Figure 6:
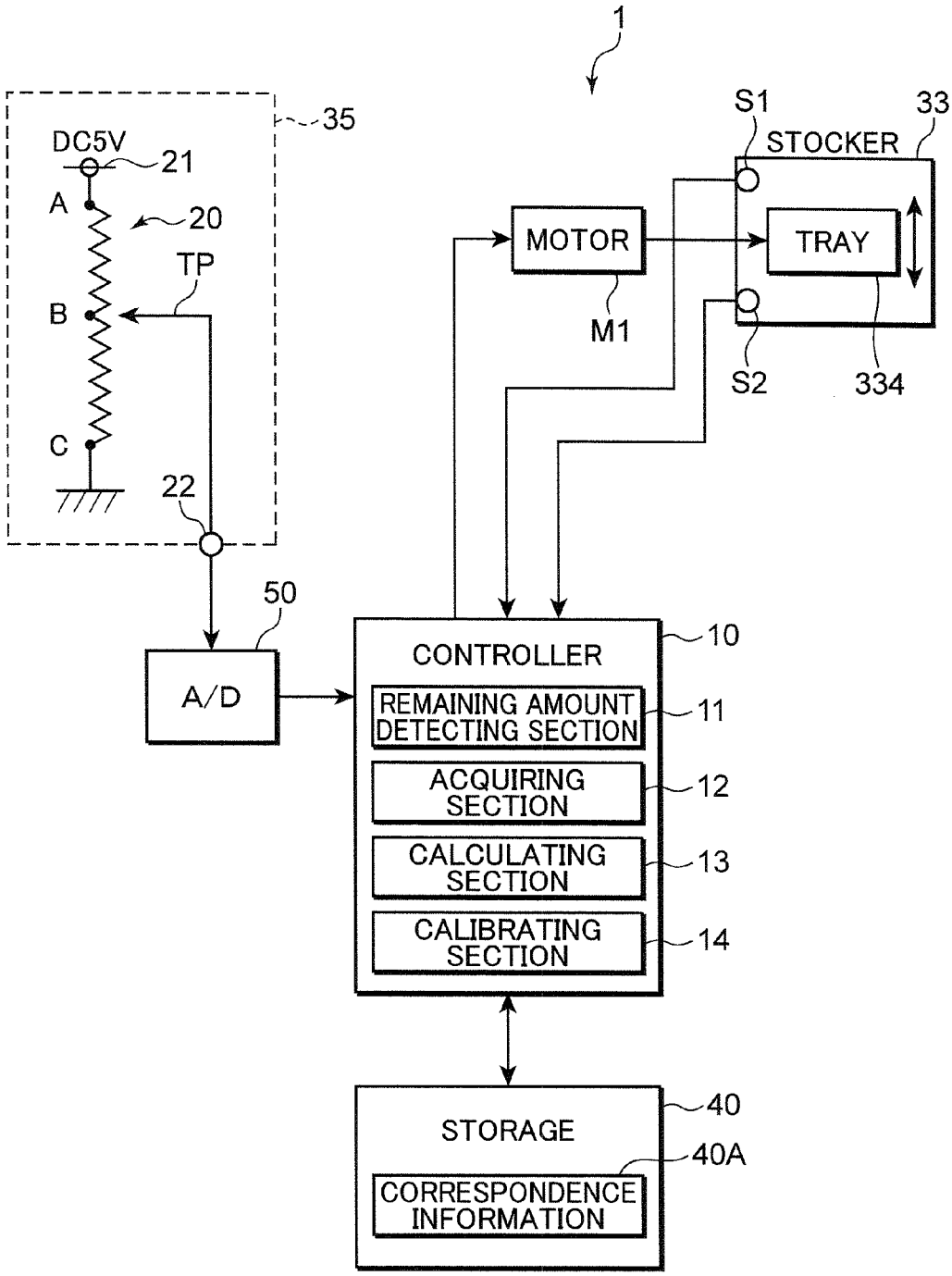
FIG. 6 is a block diagram showing an exemplary functional module of a sheet remaining amount detection device according to the embodiment of the invention.

FIG. 6 is a block diagram showing an exemplary functional module of the sheet remaining amount detection device according to the embodiment of the present invention.

The sheet remaining amount detection device 1 includes the position detector 35 shown in FIG. 4. The position detector 35 includes a voltage value output unit (level value output unit) composed of the slide resistor 20 and an output terminal (output unit) 22.

The slide resistor 20 is connected between a power source 21 which outputs a direct-current power signal of a preset power supply voltage Vs (e.g. 5V) and a GND (circuit ground). An intermediate tap TP which slides on a resistive element together with the slide member 20B is connected to the output terminal 22. It is assumed below that an end position of the resistive element of the slide resistor 20 at the side of the power source 21 is the position A, an end position thereof at the side of the GND is the position C and a position thereof where the intermediate tap TP is in contact is the position B.

As described above, the slide resistor 20 has a portion (the intermediate tap TP) which slides together with the slide member 20B to change the resistance value between the intermediate tap TP and the opposite ends of the resistive element, whereby the partial pressure ratio of the power supply voltage Vs by the power source 21 is changed. A partial pressure voltage obtained by dividing the power supply voltage Vs by the partial pressure ratio is output as a voltage signal Vout to an A/D conversion circuit 50 via the output terminal (output unit) 22 of the slide resistor 20. Specifically, if the resistance value between the positions A and B is R1 and that between the positions B and C is R2, Vout={R2/(R1+R2)}× Vs. In other words, the voltage signal Vout corresponding to the resistance values R1, R2 of the slide resistor 20 is output.

Specifically, the voltage value output unit outputs a signal indicating a voltage value (level value) corresponding to the slide position of the slide member 20B as a signal indicating the present position D of the first wire W1 on the first pulley 341 to the A/D conversion circuit 50. Then, the signal indicating the present position D of the first wire W1 is converted into a digital signal by the A/D conversion circuit 50 and this digital signal is output to a remaining amount detecting section 11.

For example, in the slide resistor 20, the partial pressure ratio {R2/(R1+R2)} is zero and a voltage signal Vout of 0 V arrives at the A/D conversion circuit 50 when the slide member 20B is located at the position C. Then, this voltage signal Vout of 0 V is converted into a digital signal by the A/D conversion circuit 50 and output to the remaining amount detecting section 11.

When the slide member 20B is located at the position A, the partial pressure ratio {R2/(R1+R2)} is 1 and a voltage signal Vout of 5 V arrives at the A/D conversion circuit 50. Then, this voltage signal Vout of 5 V is converted into a digital signal by the A/D conversion circuit 50 and output to the remaining amount detecting section 11.

When the slide member 20B is located at the position B between the positions A and C, the partial pressure ratio has an intermediate value and a voltage signal of, e.g. 2.5 V arrives at the A/D conversion circuit 50. Then, this voltage signal Vout of 2.5 V is converted into a digital signal by the A/D conversion circuit 50 and output to the remaining amount detecting section 11.

In the following description, it is assumed that the position of the slide member 20B when the upper surface of the first tray 334 is located at the sheet pickup position PH is the position C and the position of the slide member 20B when the upper surface of the first tray 334 is located at the lowest position PL is the position A.

Correspondence information 40A obtained using the respective voltage values when the upper surface of the first tray 334 is located at the respective sheet pickup position PH and lowest position P1 is stored in a storage 40 beforehand. Such correspondence information 40A indicates a correspondence relationship between the voltage value obtained by the A/D conversion circuit 50 and the sheet remaining amount.

As described above, the voltage value obtained by the A/D conversion circuit 50 linearly changes as the upper surface of the first tray 334 moves upward from the lowest position PL toward the sheet pickup position PH. Thus, the correspondence information 40A stored in the storage 40 may be information indicating a regression line passing through a point determined by a preset voltage value VH (e.g. 0 V) and a preset sheet remaining amount (e.g. 0 sheet) corresponding to the voltage value VH and a point determined by a voltage value VL (e.g. 5 V) larger than the voltage value VH and a preset sheet remaining amount (e.g. 1000 sheets) corresponding to the voltage value VL.

Here, the voltage value VH is a voltage value supposed to be obtained by the A/D conversion circuit 50 when the upper surface of the first tray 334 is located at the sheet pickup position PH and the voltage value VL is a voltage value supposed to be obtained by the A/D conversion circuit 50 when the upper surface of the first tray 334 is located at the lowest position PL.

Although the voltage values VH and VL and the correspondence information 40A described above are stored as fixed data in the storage in the above example, the present invention is not limited to this example and the sheet remaining amount detection device 1 may obtain the respective voltage values and correspondence information 40A by performing the following process using a controller 10.

For example, the controller 10 causes the first motor M to be described later to move the first tray 334 upward from the lowest position PL toward the sheet pickup position PH, obtains a voltage value when obtaining a detection signal by a lowest position detection sensor S2 as the above voltage value VL, and obtains a voltage value when obtaining a detection signal by a sheet pickup position detection sensor S1 as the above voltage value VH in the process of moving the first tray 334 upward. Then, the controller 10 generates correspondence information 40A using the obtained voltage values VH and VL and stores it in the storage 40.

Note that the correspondence information 40A may also be information set beforehand so that the voltage value successively changes every time the sheet remaining amount, i.e. the remaining number of sheets corresponding to the voltage value decreases by a unit number (e.g. by 1) from a predetermined maximum number.

This is described here. The controller 10 includes an acquiring section 12, a calculating section 13 and a calibrating section 14. The controller 10 obtains the respective voltage values VH (e.g. 0 V) and VL (e.g. 5 V) at the time of detection by the sheet pickup position detection sensor S1 and the lowest position detection sensor S2.

The acquiring section 12 acquires a changed amount of a level value when a unit number of sheets SH on the first tray 334 are picked up. In other words, the acquiring section 12 causes the unit number of sheets SH on the first tray 334 to be actually picked up and actually measures a changed amount ΔV of the voltage value at that time. For example, it is assumed that ΔV of 0.1 V was actually measured when 10 sheets were picked up.

The calculating section 13 calculates a maximum sheet number as the number of remaining sheets corresponding to the voltage value VL using the following equation. As described above, VL is a voltage value when the first tray 334 is located at the lowest position PL and VH is a voltage value when the first tray 334 is located at the sheet pickup position PH.

$$\text{Maximum sheet number}=(\text{unit number}/\Delta V)\times(VL-VH)$$

Since the unit number is 10, ΔV=0.1V, VL=5 V and VH=0 V, the maximum sheet number is 500.

Then, the calibrating section 14 calibrates the correspondence information using the maximum sheet number and the changed amount ΔV. More specifically, the calibrating section 14 sets the voltage value and the remaining sheet number corresponding to the voltage value so that the remaining sheet number changes by the unit number every time the voltage value changes by the changed amount ΔV from VL toward VH. Here, the remaining sheet amount is 500 at 5V, 490 at 4.9 V, 480 at 4.8 V, . . . , 20 at 0.2 V, 10 at 0.1 V and 0 at 0 V.

In this way, suitable correspondence information 40A can be obtained according to a difference in the thickness of the sheets SH on the first tray 334.

The sheet remaining amount detection device 1 also includes the first motor M1 for moving the first tray 334 upward.

The controller 10 controls the first motor M1 to move the first tray 334 upward so that the uppermost one of the sheets SH placed on the first tray 334 is located at the sheet pickup position PH. This enables the sheets placed on the first tray 334 to be picked up by the sheet pickup roller 413A.

The controller 10 includes the remaining amount detecting section 11 for detecting the remaining amount of the sheets on the first tray 334. The remaining amount detecting section 11 receives a voltage value obtained by the A/D conversion circuit 50, detects the sheet remaining amount corresponding to this voltage value using the correspondence information 40A represented, for example, by a regression line, and displays the detected sheet remaining amount using an unillustrated display circuit.

Figure 7:
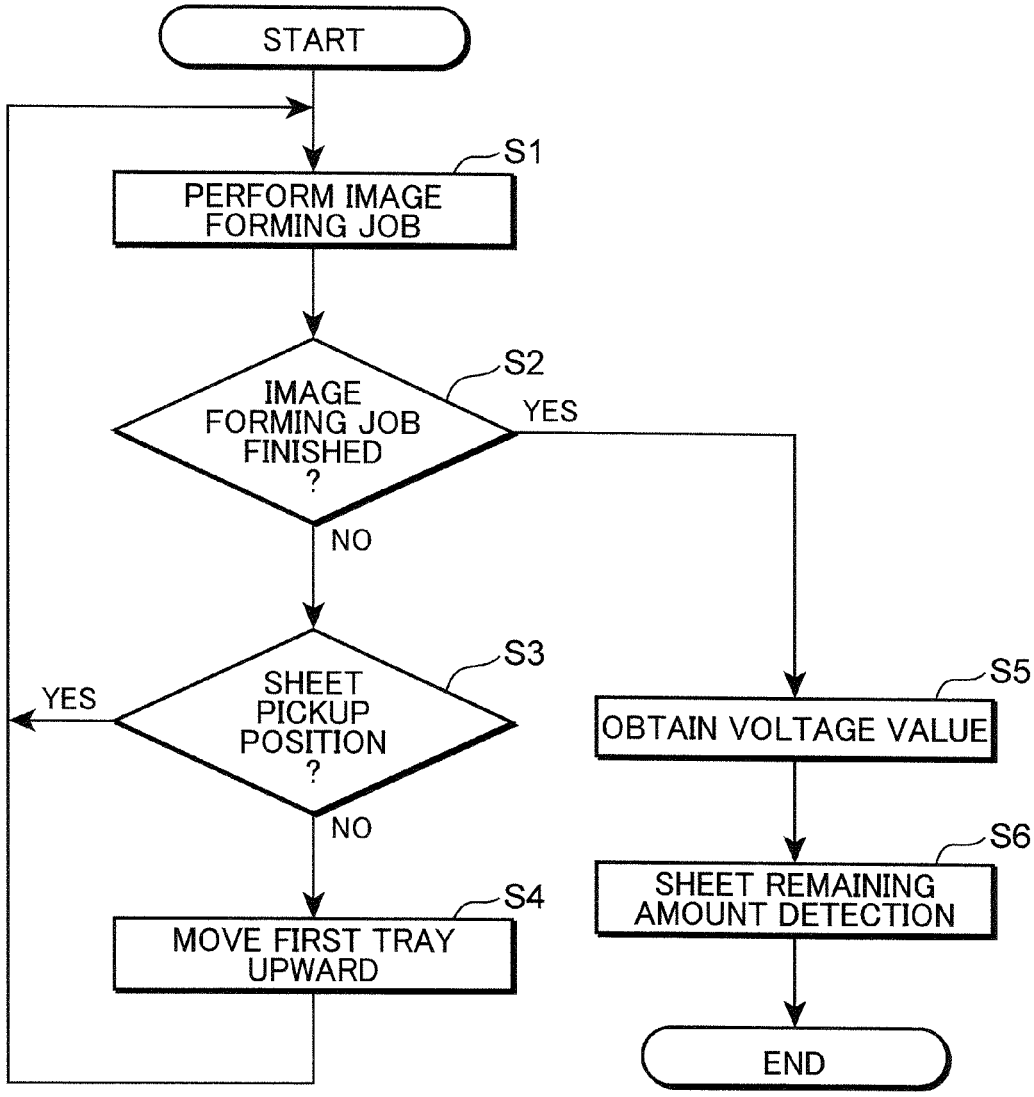
FIG. 7 is a flow chart showing an operation of detecting a sheet remaining amount using the sheet remaining amount detection device according to the embodiment of the invention.

An operation of detecting the sheet remaining amount using the sheet remaining amount detection device 1 according to this embodiment is described. FIG. 7 is a flow chart showing this operation. The image forming apparatus A shown in FIG. 1 is used as a printer. A user performs an operation to transmit image data desired to be printed to the image forming apparatus A using a personal computer or the like. In this way, the image data is transmitted to the image forming apparatus A from the personal computer or the like and the image forming unit 5 performs an image forming job (Step S1).

The controller 10 judges whether or not the image forming job has been finished (Step S2). The controller 10 judges whether or not the uppermost sheet SH on the first tray 334 is located at the sheet pickup position PH (Step S3) when judging that the image forming job has not been finished (NO in Step S2).

The controller 10 returns to Step S1 when judging that the uppermost sheet SH on the first tray 334 is located at the sheet pickup position PH (YES in Step S3). On the contrary, when judging that the uppermost sheet SH on the first tray 334 is not at the sheet pickup position PH (NO in Step S3), the controller 10 controls the first motor M1 to move the first tray 334 upward (Step S4) and returns to Step S1. In this way, the uppermost sheet SH on the first tray 334 comes to be located at the sheet pickup position PH.

When judging that the image forming job has been finished (YES in Step S2), the controller 10 obtains a voltage value from the position detector 35 (Step S5). This voltage value is a value generated by the resistance value of the slide resistor 20 corresponding to the present position D of the first wire W1.

The remaining amount detecting section 11 detects the remaining amount of the sheets placed on the first tray 334 using the above voltage value (Step S6) and causes a display (not shown) provided on the image forming apparatus A to display the remaining amount of the sheets.

As described above, according to the sheet remaining amount detection device 1 of this embodiment, the remaining amount of the sheets on the first tray 334 is detected based on the present position D as shown in FIGS. 4A and 4B. The present position D is the position of a section d most distant from the first wind out of a part of the first wire W1 taken up on the first pulley 341. In other words, the present position D is an end position of the last wind in the axial direction of the first pulley 341, and the section d is an end section of the taken-up part of the first tray W1. Thus, the sheet remaining amount can be detected based on the position of the section d in the axial direction which position does not change even after power is applied again. Thus, the sheet remaining amount can be detected without wasting power consumption.

In this embodiment, it is assumed that the partial pressure ratio of the slide resistor 20 is highest when the upper surface of the first tray 334 is located at the lowest position PL while being lowest when the upper surface of the first tray 334 is located at the sheet pickup position PH.

However, the present invention is not limited to this example and the partial pressure ratio of the slide resistor 20 may be highest when the upper surface of the first tray 334 is located at the sheet pickup position PH while being lowest when the upper surface of the first tray 334 is located at the lowest position PL.

Construction examples of the first pulley 341 are described below. Note that the second pulley 342 is neither described nor shown since having the same construction as the first pulley 341.

As described above, the first pulley 341 takes up the first wire W1 such that the winds of the first wire W1 are successively aligned in the axial direction. First pulleys 341 suitably shaped to take up the first wire W1 such that the winds of the first wire W1 are successively aligned in the axial direction are illustrated in FIGS. 8A and 8B, FIGS. 9A and 9B and FIGS. 10A and 10B.

Figure 8B:
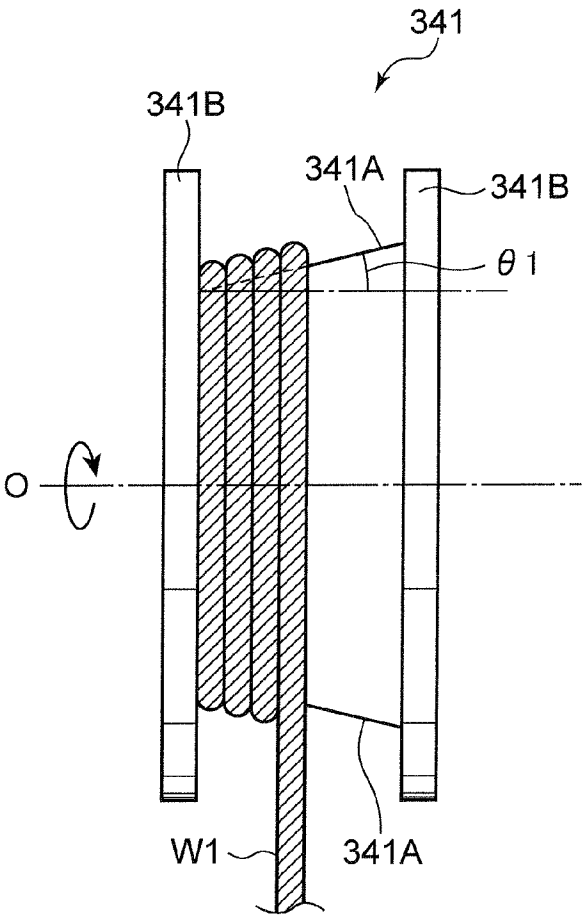
FIGS. 8A and 8B are side views showing an exemplary construction of a first pulley.
Figure 8A:
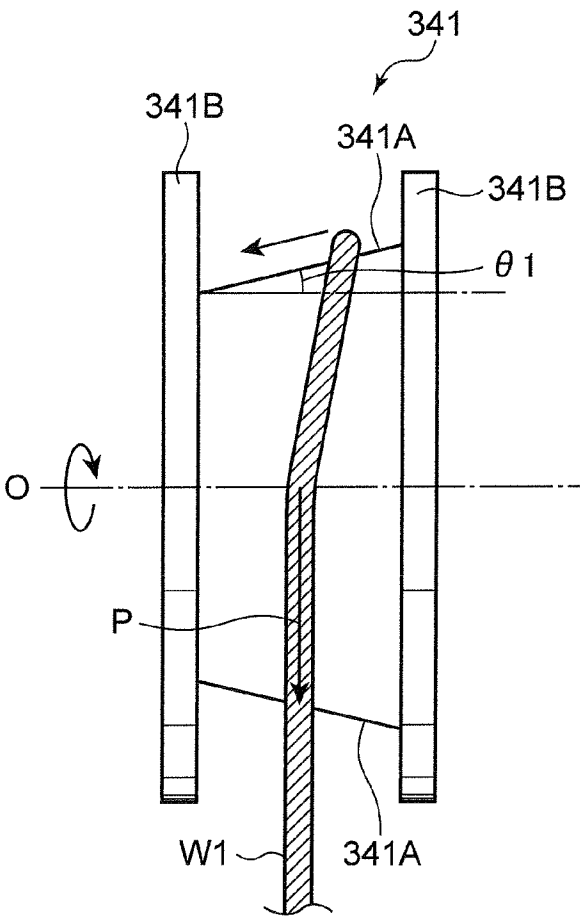

FIGS. 8A and 8B are side views showing an exemplary construction of the first pulley 341. A surface 341A of the first pulley 341 is tapered from the right end to the left end of the first pulley 341, and this tapered surface is at a taper angle of θ1 to the axial direction of the first pulley 341.

The first pulley 341 includes a pair of jaw portions 341B. The pair of jaw portions 341B prevent the first wire W1 already taken up on the first pulley 341 from coming off the first pulley 341.

According to this construction, if it is started to take up the first wire W1 when the first wind of the first wire W1 is located at an intermediate position between the left end and the right end of the first pulley 341 as shown in FIG. 8A, a load is exerted on the surface 341 due to a tensile force P acting on the first wire W1 in a direction toward the fixed pulley 343 (see FIG. 3).

Since this load increases as the take-up diameter of the first wire W1 increases, the first wire W1 slides toward a small-diameter side of the first pulley 341, i.e. toward the left end so as to reduce the load on the surface 341A of the first pulley 341.

Thus, when it is started to take up the first wire W1, for example, with the first wind of the first wire W1 located at the left end of the first pulley 341, the first wire W1 can be successively taken up while the already taken-up part of the first wire W1 is sliding toward the left side.

As a result, the first wire W1 is successively taken up to abut on the already taken-up part of the first wire W1. In this way, the first wire W1 is taken up with the winds thereof closely aligned in the axial direction as shown in FIG. 8B, wherefore accuracy in detecting the sheet remaining amount based on the present position D of the first wire W1 is improved.

Figure 9B:
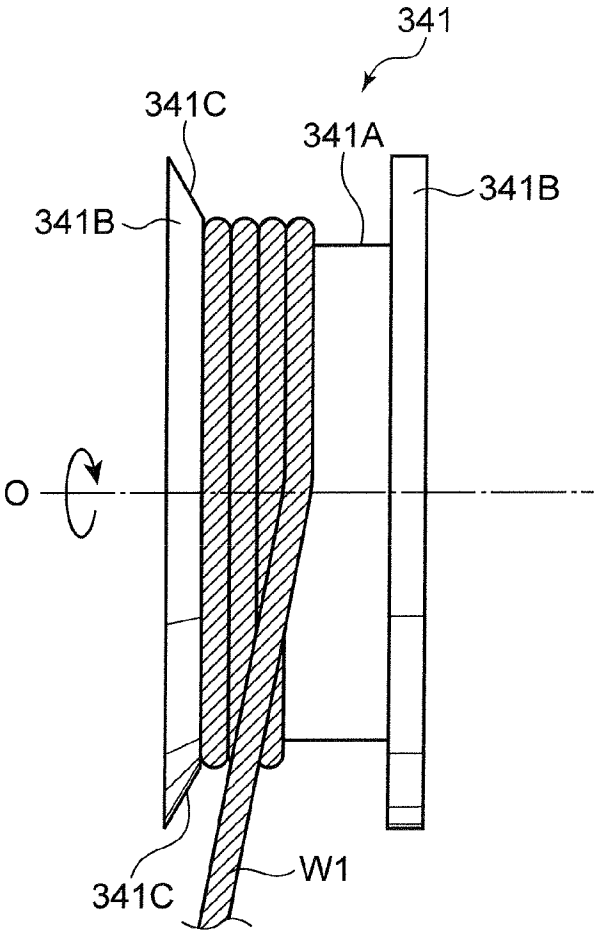
FIGS. 9A and 9B are side views showing another exemplary construction of the first pulley.
Figure 9A:
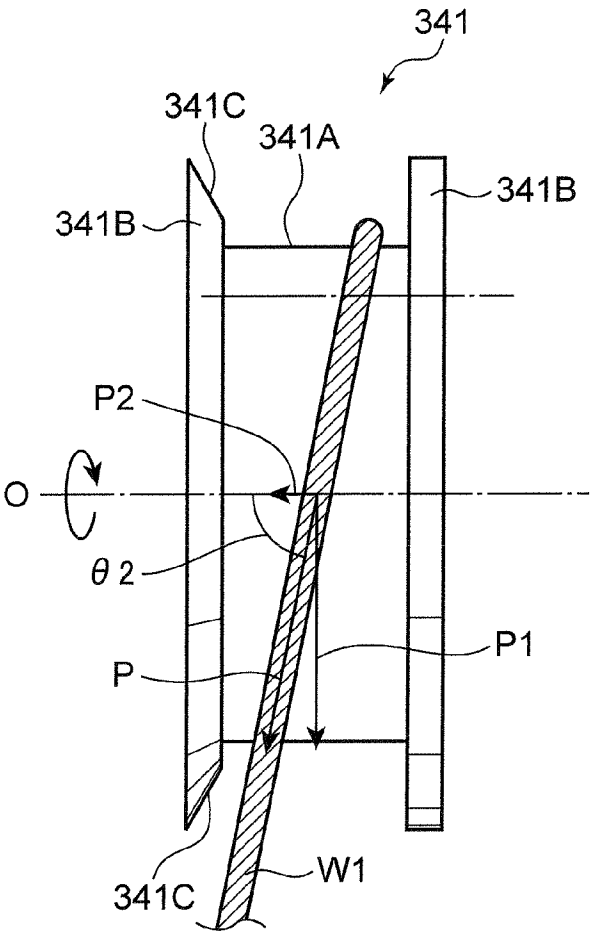

FIGS. 9A and 9B are side views showing another construction example of the first pulley 341. The construction shown in FIGS. 9A and 9B differs from that shown in FIGS. 8A and 8B in that the surface 341A of the first pulley 31 is cylindrical and the jaw portion 341B at the left end is formed with an inclined surface 341C inclined outwardly from the inner side toward the outer side.

According to this construction, the first pulley 341 and the fixed pulley 343 are so arranged that an angle between a direction of a tensile force P acting on the wire W1 toward the fixed pulley 343 (see FIG. 3) and the axial direction of the first pulley 341 is an acute angle θ2 at a side where the take-up of the first wire W1 is started, i.e. at the left end side of the first pulley 341 as shown in FIG. 9A. Specifically, the first pulley 341 and the fixed pulley 343 are in such a positional relationship as to be arranged one after the other in a depth direction of the plane of FIG. 3. When it is started to take up the wire first wire W1, the direction of the tensile force P acting on the first wire W1 is broken down into a vector P2 of a direction toward the left end of the first pulley 341 along the axial direction of the first pulley 341 and a vector P1 of a direction perpendicular to the former vector direction.

Thus, when the first wire W1 is taken up on the first pulley 341, the vector P2 of the direction toward the left end of the first pulley 341 along the axial direction acts on the first wire W1, wherefore the first wire W1 slides in a direction toward the left jaw portion 341B. Thus, when it is started to take up the first wire W1 in a state shown in FIG. 9A, the first wire W1 is successively taken up to abut on the already taken-up part of the first wire W1. As a result, the first wire W1 is taken up with the winds thereof closely aligned in the axial direction as shown in FIG. 9B, wherefore accuracy in detecting the sheet remaining amount based on the present position D of the first wire W1 is improved.

Note that, in the construction shown in FIGS. 9A and 9B, the inclined surface 341C is provided to prevent the first wire W1 and the jaw portion 341B from being scraped against each other to be abraded when the first wire W1 is taken up.

Here, the first wire W1 is supported by the fixed pulley 343 between the first pulley 341 and the first tray 334. The width of a groove in the fixed pulley 343 into which the first wire W1 is fitted is normally substantially equal to that of the first wire W1.

Thus, even if the tensile force P acting on the first wire W1 in the direction toward the fixed pulley 343 acts in the direction at the acute angle θ2 to the axial direction of the first pulley 341, i.e. acts in a direction which is not perpendicular to the axial direction as shown in FIGS. 9A and 9B when the first pulley 341 rotates, the tensile force P has its direction vertically converted by the fixed pulley 343 and is transmitted to the first tray 334.

As a result, even if the tensile force P acts on the first wire W1 in a direction not perpendicular to the axial direction of the first pulley 341 when the first pulley 341 rotates, the first tray 334 can be smoothly moved in the vertical direction.

Figure 10B:
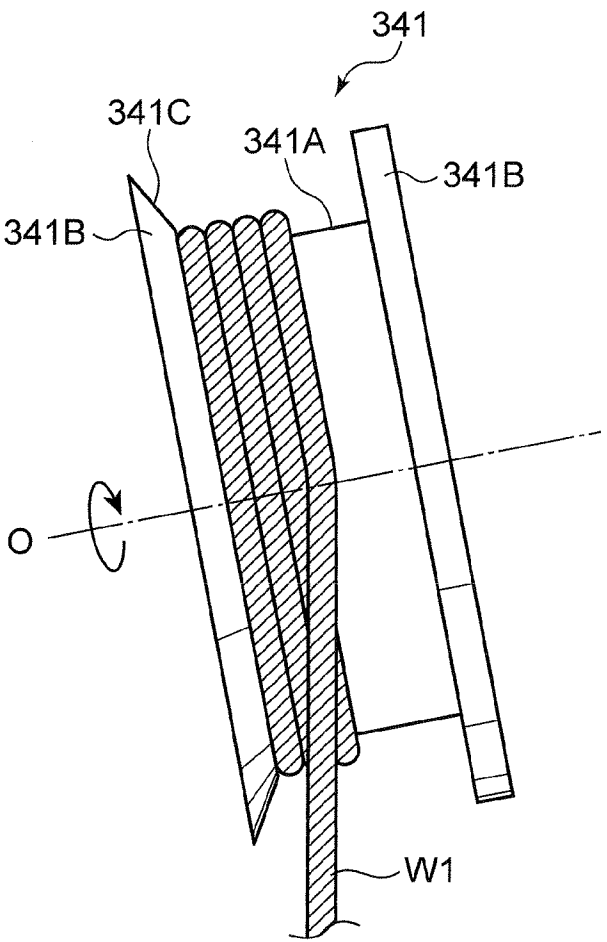
FIGS. 10A and 10B are side views showing a modification of the other exemplary construction of the first pulley.
Figure 10A:
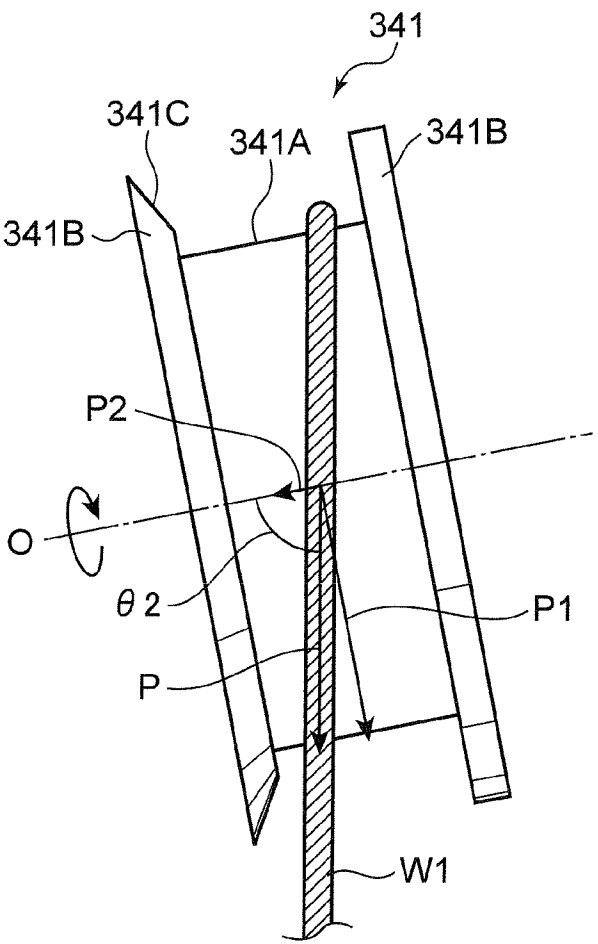

Note that the construction shown in FIGS. 9A and 9B may take up the first wire W1 while being arranged as shown in FIGS. 10A and 10B. FIGS. 10A and 10B show another use example of the first pulley shown in FIGS. 9A and 9B.

The shaft of the first pulley 341 is so inclined that an acute angle θ2 is formed between a direction of a tensile force P and the axial direction of the first pulley 341 at the side where the take-up of the wire W1 is started (i.e. at the left end side of the first pulley 341). In this case, the first pulley 341 and the fixed pulley 343 are arranged substantially at the same position in the depth direction of the plane of FIG. 3. The tensile force P is a force acting on the first wire W1 in a direction toward the fixed pulley 343 (see FIG. 3) as shown in FIG. 10A.

Also in this example, the direction of the tensile force P acting on the first wire W1 is broken down into a vector P2 of a direction toward the left end of the first pulley 341 along the axial direction of the first pulley 341 and a vector P1 of a direction perpendicular to the vector P2.

Thus, when the first wire W1 is taken up on the first pulley 341, the vector P2 acts on the first wire W1 in the direction toward the left end of the first pulley 341 along the axial direction, wherefore the first wire W1 slides in a direction toward the left jaw portion 341B. Thus, when it is started to take up the first wire W1 in a state shown in FIG. 10A, the first wire W1 is successively taken up to abut on the already taken-up part of the first wire W1. As a result, the first wire W1 is taken up with the winds thereof closely aligned in the axial direction as shown in FIG. 10B, wherefore accuracy in detecting the sheet remaining amount based on the present position D of the first wire W1 is improved.

The sheet remaining amount detection device 1 according to this embodiment detects, as described above, the sheet remaining amount using the movement amount of the present position D of the first wire W1 on the first pulley 341 (i.e. movement amount of the take-up position of the first wire W1 on the first pulley 314 in the axial direction most distant from the first wind) as a changed amount of the voltage value obtained by the A/D conversion circuit 50.

This is preferable since the movement amount of the present position D of the first wire W1 can be transmitted to the slide member 20B while being increased.

Figure 11:
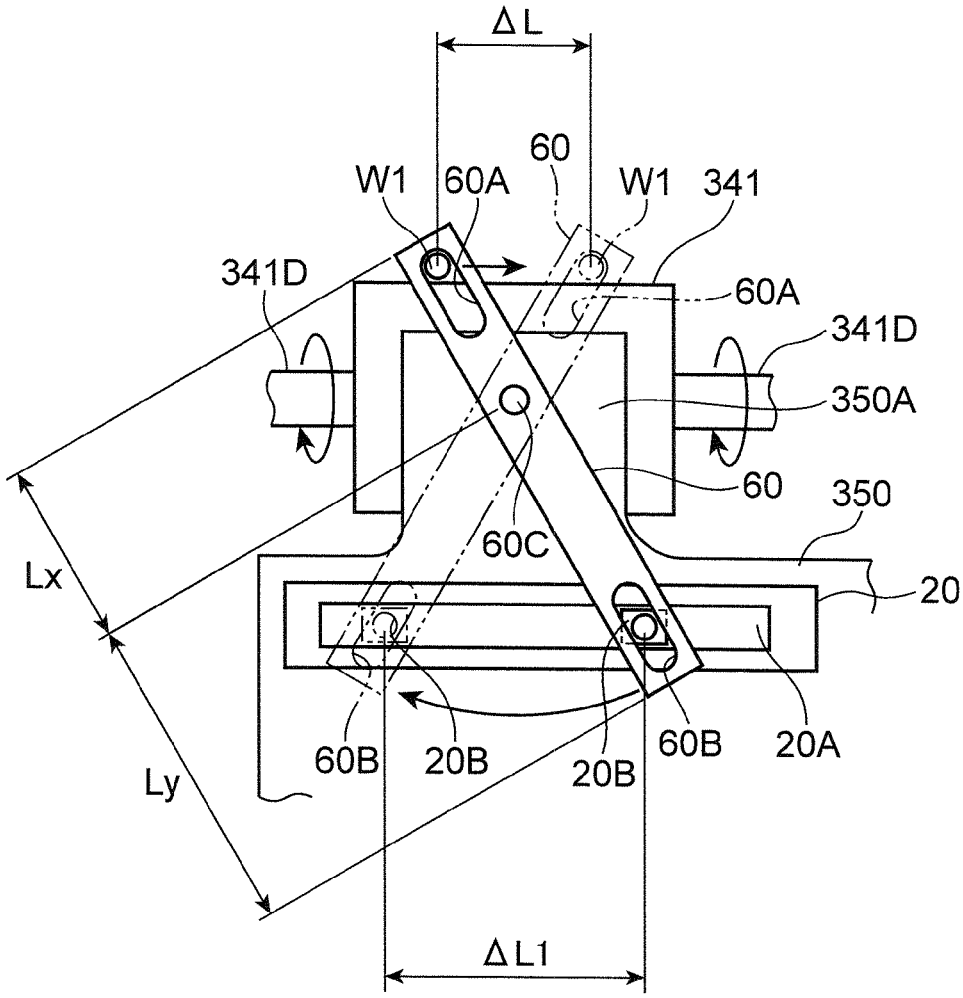
FIG. 11 is a diagram showing the construction of a link member as an example of a movement amount increasing mechanism.
Figure 12A:
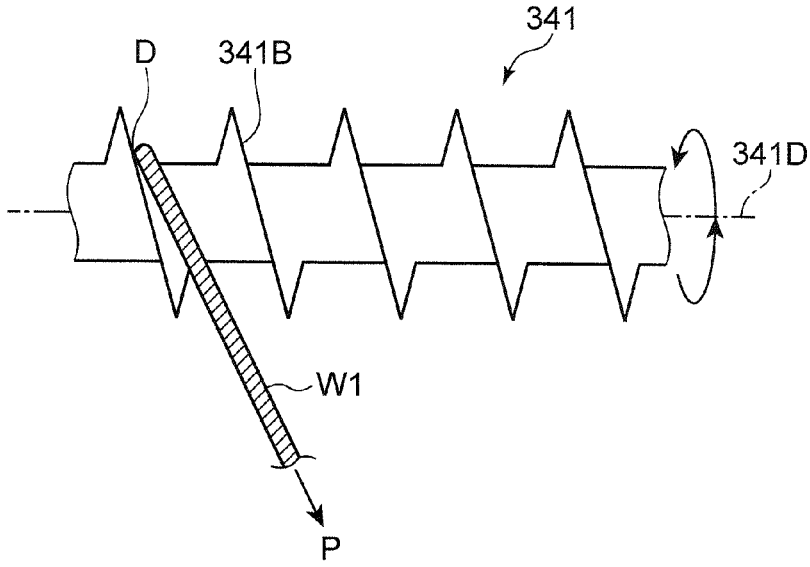
FIGS. 12A and 12B are diagrams showing the configuration of a spiral groove as an example of the movement amount increasing mechanism.
Figure 12B:
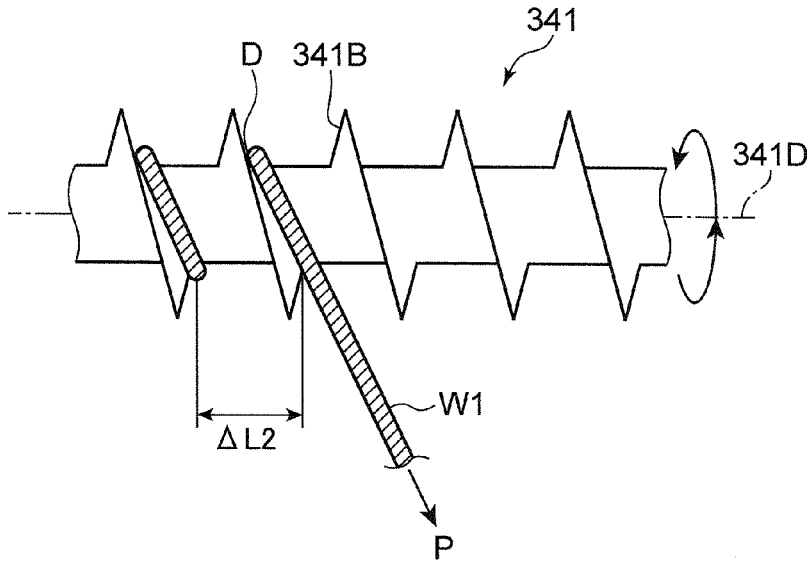

The construction of a movement amount increasing mechanism capable of transmitting the movement amount of the present position D of the first wire W1 to the slide member 20B while increasing it is illustrated in FIGS. 11, 12A and 12B.

FIG. 11 is a diagram showing the construction of a link member as an example of the movement amount increasing mechanism. In the link member 60, the first wire W1 is slidably inserted through one end 60A, and the slide member 20B is fixed to another end 60B.

The link member 60 is so mounted on an extending portion 350A of a supporting member 350 as to be rotated (or turned) about a supporting point position 60C. The supporting point position 60C is at a predetermined first distance Lx from the one end 60A and at a second distance Ly (where Lx<Ly) from the other 60B on a straight line connecting between the one end 60A and the other end 60B of the link member 60.

According to this construction, the first wire W1 inserted through the one end 60A of the link member 60 slides in the same direction as the present position D as the present position D of the first wire W1 moves in the axial direction of the first pulley 341.

Thus, the one end 60A of the link member 60 receives a moving force of the first wire W1 and moves in the same direction as the moving direction of the present position D. Then, the other end 60B of the link member 60 rotates (or turns) about the supporting point position 60C. At this time, the other end 60B of the link member 60 moves a moving distance ΔL1, which is a product of a moving distance ΔL of the one end 60A and a ratio of the second distance Ly to the first distance Lx, in a direction opposite to the one end 60A of the link member 60.

For example, if the ratio Ly to Lx is 1.5, the other end 60B of the link member 60 moves by 1.5×ΔL, which is 1.5 times as long as the moving distance ΔL of the one end 60A, in a direction opposite to the moving direction of the one end 60A, e.g. to the left when the one end 60A moves to the right.

In this way, the other end 60B of the link member 60 moves a longer distance than the one end 60A.

When a moving distance of the slide member 20B is short, accuracy in detecting the remaining amount decreases since a changed amount of the resistance value of the slide resistor 20 is small. In the construction shown in FIG. 11, the moving distance of the slide member 20B can be made longer than that of the present position D of the first wire W1. Accordingly, if the amount of the first wire W1 taken up on the first pulley 341 is small (i.e. if the moving distance of the present position D of the first wire W1 is short) from the last remaining amount detection to the remaining amount detection this time, accuracy in detecting the remaining amount can be improved since the moving distance of the slide member 20B can be made longer.

FIGS. 12A and 12B are diagrams showing the configuration of a spiral groove as an example of the movement amount increasing mechanism. The first pulley 341 is formed with a spiral groove 341B used to successively take up the first wire W1 as the first pulley 341 rotates.

According to this construction, when the first pulley 341 rotates, the first wire W1 is taken up along the groove 341B, wherefore a movement amount ΔL2 of the present position D in the axial direction every time the number of the winds of the first wire W1 on the first pulley 341 increases by one is larger than that in the case where the first pulley 341 is not formed with the groove 341B.

Thus, the movement amount of the present position D in the axial direction of the first pulley 341 can be transmitted to the slide member 20B while being increased.

Here, the first wire W1 is supported by the fixed pulley 343 between the first pulley 341 and the first tray 334 as described above. The width of the groove in the fixed pulley 343, into which the first wire W1 is fitted, is normally substantially equal to that of the first wire W1.

Thus, even if a tensile force P acting on the first wire W1 in a direction toward the fixed pulley 343 acts in a direction which is not perpendicular to the direction of the rotating shaft of the first pulley 341 as shown in FIGS. 12A and 12B when the first pulley 341 rotates, the tensile force P is transmitted to the first tray 334 while having the direction thereof converted into the vertical direction by the fixed pulley 343.

As a result, even if the tensile force P acting on the first wire W1 acts in a direction not perpendicular to the direction of the rotating shaft of the first pulley 341 when the first pulley 341 rotates, the first tray 334 can be smoothly moved in the vertical direction.

When the moving direction of the slide member 20B is short, accuracy in detecting the remaining amount decreases since a changed amount of the resistance value of the slide resistor 20 is small. In the construction shown in FIGS. 12A and 12B, the moving distance of the present position D of the first wire W1 per rotation of the first pulley 341 can be increased. Accordingly, the moving distance of the present position D of the first wire W1 can be increased even if the amount of the first wire W1 taken up on the first pulley 341 is small from the last remaining amount detection last time to the remaining amount detection this time. In this way, the moving distance of the slide member 20B can be increased, wherefore accuracy in detecting the remaining amount can be improved.

Note that the above embodiment mainly includes inventions having the following constructions.

A sheet remaining amount detection device according to one aspect of the present invention includes a sheet storage unit which stores sheets and in which a sheet pickup position where the sheets are picked up is set beforehand; a tray which is provided in the sheet storage unit in such a manner as to be vertically movable between the sheet pickup position and a lowest position lower than the sheet pickup position and on which the sheets are to be placed; a rope connected to the tray; a pulley which includes a shaft and on which the rope is taken up with the winds of the rope aligned in an axial direction of the shaft; a motor for moving the tray upward by rotating the pulley about the shaft in a direction to take up the rope to locate the uppermost one of the sheets placed on the tray to the sheet pickup position; a position detector for detecting a present position which is a present take-up position of the rope on the pulley in the axial direction; and a remaining amount detecting section for detecting the remaining amount of the sheets placed on the tray based on the present position detected by the position detector.

According to this construction, the rope is taken up such that the winds thereof are aligned in the axial direction of the pulley when the tray is moved upward in the sheet storage unit by rotating the pulley.

The remaining amount of the sheets on the tray is detected based on the present take-up position of the rope on the pulley, i.e. the present position that is the take-up position of the rope on the pulley in the axial direction most distant from the first wind.

The present position is the present take-up position of the rope on the pulley in the axial direction. Thus, even if power is applied again after the power is cut off, the present position does not change. Accordingly, even after power is applied again, the sheet remaining amount can be continuously detected without confirming the present position of the tray again. Therefore, the sheet remaining amount can be detected without wasting power consumption.

The sheet remaining amount detection device according to the one aspect of the present invention can be redefined as follows. The sheet remaining amount detection device includes a sheet storage unit which stores sheets and in which a sheet pickup position where the sheets are picked up is set beforehand; a tray on which the sheets are to be placed and which is vertically movable in the sheet storage unit; a motor for vertically moving the tray to locate the uppermost one of the sheets placed on the tray to the sheet pickup position; a rope having one end fixed to the tray; a pulley for moving the tray by taking up the rope such that the winds of the rope are successively aligned from the other end toward the one end in an axial direction of the pulley; a position detector for detecting a present position which is a present take-up position of the rope on the pulley in the axial direction; and a remaining amount detecting section for detecting the remaining amount of the sheets placed on the tray based on the present position detected by the position detector.

In the above construction (1), a distance from the lowest position to the sheet pickup position of the tray is set at a length of the rope taken up on the pulley in one direction from one side toward the other side of the shaft.

According to this construction (one-way take-up construction), a movement of the tray from the lowest position to the sheet pickup position is completed by taking up the rope in one direction from one side toward the other side of the shaft of the pulley, for example, as shown in FIGS. 4A and 4B. Thus, the present position, which is the take-up position in the axial direction, and the sheet remaining amount can be in a one-to-one correspondence. In a construction in which the rope is taken up on the pulley in two ways from the one side toward the other side and from the other side toward the one side of the shaft (two-way take-up construction), the present position and the sheet remaining amount are not in a one-to-one correspondence. Therefore, the one-way take-up construction can realize the detection of the sheet remaining amount by a simpler construction as compared with the two-way take-up construction.

In a sheet feeder incorporated into an image forming apparatus, the distance between the lowest position and the sheet pickup position is as short as several tens of centimeters. Thus, the one-way take-up construction can be applied to the sheet feeder of the image forming apparatus.

In the above construction (1), the position detector includes a slide member which slides in the axial direction according to the present position of the rope on the pulley; and a level value output unit for outputting a signal indicating a level value corresponding to a slide position of the slide member as a signal indicating the present position to the remaining amount detecting section.

According to this construction, the slide member slides in the axial direction of the pulley according to the present position of the rope on the pulley, i.e. the take-up position of the rope on the pulley closest to the tray in the axial direction. The signal indicating the level value corresponding to the slide position of the slide member is output as the signal indicating the present position of the rope to the remaining amount detecting section.

In this way, the present position of the rope on the pulley, which changes as the rope is taken up on the pulley, can be linearly notified to the remaining amount detecting section.

In the above construction (3), the level value output unit includes a slide resistor which has a portion which slides together with the slide member; and an output unit for outputting a signal corresponding to the resistance value of the slide resistor.

According to this construction, the level value output unit includes the slide resistor and the output unit for outputting the signal corresponding to the resistance value of the slide resistor, wherefore the level value output unit can be easily constructed at a low cost.

In the above construction (3), the slide member slides in parallel to the axial direction of the pulley and is formed with a through hole, through which the rope is slidably inserted; and the rope moves the slide member in the axial direction while sliding through the through hole upon being taken up on the pulley.

According to this construction, the rope inserted through the through hole formed in the slide member moves the slide member in the axial direction of the pulley while sliding through the through hole upon being taken up on the pulley.

This can easily make the slide member slide in the axial direction of the pulley.

In the above construction (3), a link member is further provided which is formed with a through hole, through which the rope is slidably inserted, in one end and has the slide member fixed to the other end thereof; the link member rotates about a supporting point position at a predetermined first distance from the one end of the link member and at a second distance, which is longer than the first distance, from the other end of the link member on a straight line connecting between the one and the other ends of the link member; and the rope rotates the one end of the link member about the supporting point position while sliding through the one end of the link member upon being taken up on the pulley.

According to this construction, the rope moves the one end of the link member in the axial direction of the pulley while sliding through the through hole formed in the one end of the link member upon being taken up on the pulley.

Then, the link member rotates about the supporting point position at the predetermined first distance from the one end of the link member and at the second distance, which is longer than the first distance, from the other end of the link member on the straight line connecting between the one end of the link member and the other end of the link member having the slide member fixed thereto.

As a result, the link member serves as a lever, and the slide member moves a distance, which is a product of a moving distance of the present position of the rope and a ratio of the second distance to the first distance.

Thus, even if the moving distance of the present position of the rope is short, the moving distance of the slide member can be transmitted to the remaining amount detecting section while being increased. As a result, accuracy in detecting the sheet remaining amount is improved.

In the above construction (3), the pulley is formed with a spiral groove used to successively take up the rope according to the rotation thereof.

According to this construction, since the pulley is formed with the spiral groove, a moving distance of a reference position of the rope per rotation of the pulley increases as compared with the case where the spiral groove is not formed.

Thus, even if the amount of the rope taken up on the pulley from the last remaining amount detecting section to the remaining amount detecting section this time is small, the moving distance of the present position of the rope can be increased. Since this can increase the moving distance of the slide member, accuracy in detecting the sheet remaining amount can be improved.

In the above construction (1), the pulley has a tapered shape with a preset angle to the axial direction of the pulley so that the diameter of the pulley increases with distance from a rope take-up starting position.

According to this construction, the pulley has the tapered shape with the preset angle to the axial direction of the pulley so that the diameter of the pulley increases with distance from the rope take-up starting position.

Thus, the rope is successively taken up while sliding toward the rope take-up starting position on the pulley. As a result, the rope can be taken up such that the winds thereof are closely aligned in the axial direction of the pulley, wherefore accuracy in detecting the sheet remaining amount based on the present position of the rope is improved.

In the above construction (1), the pulley is arranged to incline the shaft thereof such that an angle between a direction of a tensile force acting on the rope on the pulley and the axial direction of the pulley is an acute angle at a side where the take-up of the rope is started.

According to this construction, the direction of the tensile force acting on the rope is broken down into a vector of a direction toward the rope take-up starting position along the axial direction of the pulley and a vector of a direction perpendicular to the former vector when the rope is taken up.

Thus, the rope is successively taken up while sliding toward the rope take-up starting position on the pulley. As a result, the rope can be taken up such that the winds thereof are closely aligned in the axial direction of the pulley, wherefore accuracy in detecting the sheet remaining amount based on the present position of the rope is improved.

In the above construction (1), correspondence information indicating a correspondence relationship between the level value and the remaining amount of the sheets corresponding to the level value is set beforehand for detection of the sheet remaining amount by the remaining amount detecting section; the level value and the number of remaining sheets, which is the sheet remaining amount, are so set beforehand in the correspondence information that the level value successively changes every time the number of remaining sheets decreases by a unit number from a predetermined maximum number; and a controller acquires a changed amount of the level value when the unit number of sheets on the tray are picked up and calibrates the correspondence information using the acquired changed amount.

According to this construction, the changed amount of the level value when the unit number of sheets on the tray are picked up is obtained and the correspondence information indicating the correspondence relationship between the level value and the number of remaining sheets is calibrated using the acquired changed amount.

Thus, suitable correspondence information can be obtained according to a difference in the thickness of the sheets on the tray. As a result, the sheet remaining amount can be suitably detected according to the difference in the thickness of the sheets on the tray.

In the above construction (10), the controller includes an acquiring section for acquiring the changed amount of the level value when the unit number of sheets on the tray are picked up; a calculating section for calculating a maximum number of sheets placeable on the tray when the tray is located at the lowest position using an equation: maximum number=(unit number/changed amount)×(level value when the tray is located at the lowest position−level value when the tray is located at the sheet pickup position); and a calibrating section for calibrating the correspondence information using the maximum number and the changed amount.

This construction has the following effects. The changed amount of the level value per unit number of sheets differs depending on each sheet remaining amount detection device due to an error of the position detector and the like. Thus, if the changed amount of the level value per unit number of sheets is uniformly set in a plurality of sheet remaining amount detection devices, the sheet remaining amount detection devices may have poor accuracy in detecting the sheet remaining amount. However, according to this construction, the changed amount of the level value per unit number of sheets is acquired and the correspondence information is calibrated for each sheet remaining amount detection device. Therefore, accuracy in detecting the sheet remaining amount can be improved in any one of the plurality of sheet remaining amount detection devices.

An image forming apparatus according to another aspect of the present invention includes any one of the above sheet remaining amount detection devices; a conveying unit for conveying the uppermost one of sheets stored in the sheet storage unit; and an image forming unit for forming an image on the sheet conveyed by the conveying unit.

Since any one of the above sheet remaining amount detection devices (1) to (11) is included according to this construction, it is possible to provide an image forming apparatus having the effects of these sheet remaining amount detection devices.

This application is based on Japanese Patent application No. 2010-149617 filed in Japan Patent Office on Jun. 30, 2010, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet remaining amount detection device, comprising:

sheet storage unit which stores sheets and in which a sheet pickup position where the sheets are picked up is set beforehand;

a tray on which the sheets are to be placed and which is provided in the sheet storage unit in such a manner as to be vertically movable between the sheet pickup position and a lowest position lower than the sheet pickup position;

a rope connected to the tray;

a pulley which includes a shaft and on which the rope is taken up with the winds of the rope aligned in an axial direction of the shaft;

a motor for moving the tray upward by rotating the pulley about the shaft in a direction to take up the rope to locate the uppermost one of the sheets placed on the tray to the sheet pickup position;

a position detector for detecting a present position of the rope on the pulley in the axial direction; and a remaining amount detecting section for detecting the remaining amount of the sheets placed on the tray based on the present position of the rope detected by the position detector.

2. An image forming apparatus, comprising:

a sheet remaining amount detection device according to claim 1;

a conveying unit for conveying the uppermost one of sheets stored in the sheet storage unit; and an image forming unit for forming an image on the sheet conveyed by the conveying unit.

3. A sheet remaining amount detection device, comprising:

sheet storage unit which stores sheets and in which a sheet pickup position where the sheets are picked up is set beforehand;

a tray on which the sheets are to be placed and which is provided in the sheet storage unit in such a manner as to be vertically movable between the sheet pickup position and a lowest position lower than the sheet pickup position;

a rope connected to the tray;

a pulley which includes a shaft and on which the rope is taken up with the winds of the rope aligned in an axial direction of the shaft;

a motor for moving the tray upward by rotating the pulley about the shaft in a direction to take up the rope to locate the uppermost one of the sheets placed on the tray to the sheet pickup position;

a position detector for detecting a present position of the rope on the pulley in the axial direction; and a remaining amount detecting section for detecting the remaining amount of the sheets placed on the tray based on the present position of the rope detected by the position detector, wherein a distance from the lowest position to the sheet pickup position of the tray is set at a length of the rope taken up on the pulley in one direction from one side toward the other side of the shaft.

4. A sheet remaining amount detection device, comprising:

a sheet storage unit which stores sheets and in which a sheet pickup position where the sheets are picked up is set beforehand;

a tray on which the sheets are to be placed and which is provided in the sheet storage unit in such a manner as to be vertically movable between the sheet pickup position and a lowest position lower than the sheet pickup position;

a rope connected to the tray;

a pulley which includes a shaft and on which the rope is taken up with the winds of the rope aligned in an axial direction of the shaft;

a motor for moving the tray upward by rotating the pulley about the shaft in a direction to take up the rope to locate the uppermost one of the sheets placed on the tray to the sheet pickup position;

a position detector for detecting a present position of the rope on the pulley in the axial direction, the position detector including a slide member which slides in the axial direction according to the present position of the rope on the pulley; and a level value output unit for outputting a signal indicating a level value corresponding to a slide position of the slide member as a signal indicating the present position to the remaining amount detecting section; and a remaining amount detecting section for detecting the remaining amount of the sheets placed on the tray based on the present position of the rope detected by the position detector.

5. A sheet remaining amount detection device according to claim 4, wherein the level value output unit includes:

a slide resistor which has a portion which slides together with the slide member; and an output unit for outputting a signal corresponding to the resistance value of the slide resistor.

6. A sheet remaining amount detection device according to claim 4, wherein:

the slide member slides in parallel to the axial direction of the pulley and is formed with a through hole, through which the rope is slidably inserted; and the rope moves the slide member in the axial direction while sliding through the through hole upon being taken up on the pulley.

7. A sheet remaining amount detection device according to claim 4, further comprising a link member which is formed with a through hole, through which the rope is slidably inserted, in one end and has the slide member fixed to the other end thereof, wherein:

the link member turns about a supporting point position at a predetermined first distance from the one end of the link member and at a second distance, which is longer than the first distance, from the other end of the link member on a straight line connecting between the one and the other ends of the link member; and the rope turns the one end of the link member about the supporting point position while sliding through the one end of the link member upon being taken up on the pulley.

8. A sheet remaining amount detection device according to claim 4, wherein the pulley is formed with a spiral groove used to successively take up the rope according to the rotation thereof.

9. A sheet remaining amount detection device, comprising:

a sheet storage unit which stores sheets and in which a sheet pickup position where the sheets are picked up is set beforehand;

a tray on which the sheets are to be placed and which is provided in the sheet storage unit in such a manner as to be vertically movable between the sheet pickup position and a lowest position lower than the sheet pickup position;

a rope connected to the tray;

a pulley which includes a shaft and on which the rope is taken up with the winds of the rope aligned in an axial direction of the shaft, the pulley having a tapered shape with a preset angle to the axial direction of the pulley so that the diameter of the pulley increases as a distance from a rope take-up starting position;

a motor for moving the tray upward by rotating the pulley about the shaft in a direction to take up the rope to locate the uppermost one of the sheets placed on the tray to the sheet pickup position;

a position detector for detecting a present position of the rope on the pulley in the axial direction; and a remaining amount detecting section for detecting the remaining amount of the sheets placed on the tray based on the present position of the rope detected by the position detector.

10. A sheet remaining amount detection device, comprising:

a sheet storage unit which stores sheets and in which a sheet pickup position where the sheets are picked up is set beforehand;

a tray on which the sheets are to be placed and which is provided in the sheet storage unit in such a manner as to be vertically movable between the sheet pickup position and a lowest position lower than the sheet pickup position;

a rope connected to the tray;

a pulley which includes a shaft and on which the rope is taken up with the winds of the rope aligned in an axial direction of the shaft, the pulley being arranged to incline the shaft thereof such that an angle between a direction of a tensile force acting on the rope on the pulley and the axial direction of the pulley is an acute angle at a side where the take-up of the rope is started;

a motor for moving the tray upward by rotating the pulley about the shaft in a direction to take up the rope to locate the uppermost one of the sheets placed on the tray to the sheet pickup position;

a position detector for detecting a present position of the rope on the pulley in the axial direction; and a remaining amount detecting section for detecting the remaining amount of the sheets placed on the tray based on the present position of the rope detected by the position detector.

11. A sheet remaining amount detection device comprising:

a sheet storage unit which stores sheets and in which a sheet pickup position where the sheets are picked up is set beforehand a tray on which the sheets are to be placed and which is provided in the sheet storage unit in such a manner as to be vertically movable between the sheet pickup position and a lowest position lower than the sheet pickup position;

a rope connected to the tray;

a pulley which includes a shaft and on which the rope is taken up with the winds of the rope aligned in an axial direction of the shaft, a motor for moving the tray upward by rotating the pulley about the shaft in a direction to take up the rope to locate the uppermost one of the sheets placed on the tray to the sheet pickup position;

a position detector for detecting a present position of the rope on the pulley in the axial direction; and a remaining amount detecting section for detecting the remaining amount of the sheets placed on the tray based on the present position of the rope detected by the position detector, wherein correspondence information indicating a correspondence relationship between the level value and the remaining amount of the sheets corresponding to the level value is set beforehand for detection of the sheet remaining amount by the remaining amount detecting section;

the level value and the number of remaining sheets, which is the sheet remaining amount, are so set beforehand in the correspondence information that the level value successively changes every time the number of remaining sheets decreases by a unit number from a predetermined maximum number; and a controller acquires a changed amount of the level value when the unit number of sheets on the tray are picked up and calibrates the correspondence information using the acquired changed amount.

12. A sheet remaining amount detection device according to claim 11, wherein the controller includes:

an acquiring section for acquiring the changed amount of the level value when the unit number of sheets on the tray are picked up;

a calculating section for calculating a maximum number of sheets placeable on the tray when the tray is located at the lowest position using an equation:

maximum number =(unit number/changed amount)x(level value when the tray is located at the lowest position—level value when the tray is located at the sheet pickup position); and a calibrating section for calibrating the correspondence information using the maximum number and the changed amount.

* * * * *